US005150749A

United States Patent [19]

Bergmann et al.

[11] Patent Number: 5,150,749

[45] Date of Patent: Sep. 29, 1992

[54] HEAT EXCHANGER APPARATUS, PARTICULARLY FOR HYBRID HEAT PUMPS OPERATED WITH NON-AZEOTROPIC WORK FLUIDS

[75] Inventors: György Bergmann; Geza Hivessy; Tamás Homola; Árpád Bakay; Mihály Horváth, all of Budapest, Hungary

[73] Assignee: Energiagazdalkodasi Intezet, Budapest, Hungary

[21] Appl. No.: 661,311

[22] Filed: Feb. 27, 1991

[30] Foreign Application Priority Data

Feb. 27, 1990 [HU] Hungary ..... 1058/90

[51] Int. Cl.[5] ..... F28F 25/02; F25B 39/00

[52] U.S. Cl. ..... 165/115; 62/114; 62/515; 165/911

[58] Field of Search ..... 165/110, 115, 118, 911; 62/114, 502, 515, 524, 525; 137/110, 599, 599.1, 601

[56] References Cited

U.S. PATENT DOCUMENTS

| | | | |
|---|---|---|---|
| 3,412,778 | 11/1968 | Witt et al. | 165/115 |
| 3,880,702 | 4/1975 | Troshenkin et al. | 137/599 |
| 4,180,123 | 12/1979 | Dixon | 62/114 |
| 4,688,397 | 8/1987 | Bakay et al. | 62/335 |
| 4,781,738 | 11/1988 | Fujiwara et al. | 62/114 |
| 4,840,042 | 6/1989 | Ikoma et al. | 62/114 |
| 4,843,837 | 7/1989 | Ogawa et al. | 62/324.1 |
| 4,924,936 | 5/1990 | McKown | 165/115 |
| 4,925,526 | 5/1990 | Havukainen | 165/115 |
| 4,967,566 | 11/1990 | Bergmann et al. | 62/101 |

FOREIGN PATENT DOCUMENTS

| | | | |
|---|---|---|---|
| 835604 | 4/1952 | Fed. Rep. of Germany . | |
| 1519742 | 3/1970 | Fed. Rep. of Germany . | |
| 3011806 | 10/1981 | Fed. Rep. of Germany | 62/525 |
| 3811852 | 2/1989 | Fed. Rep. of Germany . | |
| 131996 | 8/1982 | Japan | 165/115 |
| 893633 | 4/1962 | United Kingdom . | |

OTHER PUBLICATIONS

"Experimental Hybrid Heat Pump of 1000 kW Heating Capacity" by Gy.
Bergmann and G. Hivessy, Institute for Energetics, Budapest, Hungary in Heat Pumps—Proceedings of the 4th International Conference, (Spring 1991) pp. 27–40.
"Hybrid Heat Pump", a sales brochure published by EGI. Contracting and Engineering, H-1027 Budapest, Bem rkp. 33-34, Hungary, Fall 1991.
"Waermeuebergang in Aussenraum von Rohrbuendel-Waermeaustauschern mit Umlenkblechen" (Heat transfer in the shell of shell-and-tube type heat exchangers with baffle plates) from "VDI-Waermeatlas" (VDI Heat Atlas), pp. Gf1 to Gf6, Third Edition, 1977.
*Development Of Hybrid Heat Pumps*, Gyorgy Bergmann et al., Institute for Energetics, H-1027 Budapest, Bem rkp. 33-34., Hungary, Sep. 1988.

*Primary Examiner*—John Rivell
*Assistant Examiner*—L. R. Leo
*Attorney, Agent, or Firm*—Beveridge, DeGrandi & Weilacher

[57] ABSTRACT

Heat exchanger apparatus which includes a substantially horizontal countercurrent heat exchanger of the shell-and-tube type, particularly for hybrid heat pumps operated with non-azeotropic work fluids. The apparatus further includes fluid distributor with fluid outlets the number of which corresponds to the number of the heat exchanger tubes of the heat exchanger is provided upstream the heat exchanger, the heat exchanger tubes of which are connected each to one fluid outlet of the fluid distributor.

21 Claims, 8 Drawing Sheets

HEAT EXCHANGER APPARATUS, PARTICULARLY FOR HYBRID HEAT PUMPS OPERATED WITH NON-AZEOTROPIC WORK FLUIDS

This invention relates to heat exchanger apparatus comprising a countercurrent heat exchanger of substantially horizontal arrangement, particularly for hybrid heat pumps operated with non-azeotroptic work fluids.

The heat exchangers of the heat exchanger apparatus according to the invention are of the type in which a fluid in liquid state is changed into vapours or vice versa. With conventional work fluids such changes take place at constant temperature. There are, however, work fluids which consist of mutually well soluble components of different volatility and change their phases at continually increasing and decreasing temperatures when their liquid phase is changed into a gaseous state or vice versa, respectively. When such non-azeotropic work fluids are used in compression or hybrid heat pumps, a considerable increase of efficiency with respect to heat pumps using conventional work media may be obtained.

Hybrid heat pumps are well known in the art as apparent e.g. from EP 0 021 205 and, recently, they got into the limelight of professional interest because of their superior technical quality.

However, in the operation of hybrid heat pumps various requirements have to be heeded.

Exploitation of the advantageous phenomenon of continuously changing temperatures of the work medium in the course of heat exchange obviously requires countercurrent heat exchangers in which both the work fluid and the fluid to be cooled down or warmed up (the "external" fluid) flow in opposite directions in well confined channels such as pipes of optional cross-sectional areas or receptacles with baffle plates as in case of shell-and-tube type heat exchangers well known in the art.

Furthermore, since the concentrations of the phases of a non-azeotropic fluid differ from one another, it is necessary that both phases flow together while adjacent particles of liquid and vapour contact continuously so that their temperatures become practically equal and optimum thermodynamic results may be obtained. Such continuous contact will be ensured if the flow of the work medium is of the dipersed type in which the liquid particles finely distributed in the flowing vapours are carried away by the latter. Dispersed flow will be obtained by correspondingly selected parameters of equipment and work conditions as will be clear to the skilled art worker.

However, the flow pattern may be of composite nature in which a core of dispersed flow is surrounded by an annular border layer whereby temperature equality of the work medium phases may considerably be impaired. Such unfavourable effects can be avoided by mixer means provided in the tubes conveying the phases of the work medium such as described in EP 0 242 838.

A further difficulty arises where the work fluid flows in a number of parallel channels or tubes rather than in a single one. Obviously, in such cases both phases of the work medium have to be uniformly distributed among the channels or tubes of a heat exchanger since, otherwise, unequal courses of temperature changes may appear therein entailing losses similar to those caused by deficient dispersed flow.

The problem of even distribution of the work medium among a number of parallel channels or tubes is particularly important with heat exchangers of big industrial plants which may comprise 50 to 100 parallel heat exchanger tubes the optimum length of which may amount to 30 to 40 meters. Obviously, maintaining even distribution of both phases and their clear separation in such heat exchanger tubes mean special problems let alone obvious difficulties of manufacture, transport and erection at the site.

Various heat exchanger apparatus with vertical or horizontal heat exchangers have been suggested to exploit the advantages offered by hybrid heat pumps and to meet the difficulties set forth hereinbefore. The known devices follow the building principle of heat exchangers employed with absorption refrigerators or heat pumps. Their main deficiency lies in that they are, by principle, incapable to warrant a suitable course of temperature change of the phases of their work media without which optimum efficiency of hybrid heat pumps cannot be obtained.

The main object of the present invention is the provision of another heat exchanger apparatus which is suitable to meet all requirements as regards functional and structural aspects of hybrid heat pumps operated with non-azeotropic work fluids, particularly the requirement of concurrent temperature changes of the work fluid phases independent of the size of the plant and in a simple manner. In view of the special nature of flow requirements and work fluids heat exchanger apparatus comprising countercurrent heat exchangers of substantially horizontal arrangement and of the shell-and-tube type are suggested. According to the key idea of the invention even distribution of the work fluid phases among the heat exchanger tubes will be obtained by providing a fluid distributor upstream the heat exchanger if the phases of the work fluid arrive separately as pure liquid and pure vapour, respectively. Then, the fluid distributor has the sole task to evenly distribute the incoming pure phases among the heat exchanger tubes of the heat exchanger for which purpose it has, in addition to inlets for introducing the phases, a plurality of outlets such as pipes the number of which corresponds to the number of the heat exchanger tubes so that direct and individual connections between the outlets of the fluid distributor and the heat exchanger tubes of the heat exchanger are readily feasible and, thereby, the main object of the invention, viz. an even distribution of the work fluid phases among the heat exchanger tubes achieved.

Thus, in its broadest sense, the present invention is concerned with heat exchanger apparatus comprising a substantially horizontal countercurrent heat exchanger of the shell-and-tube type, particularly for hybrid heat pumps operated with non-azeotropic work fluids. As has been shown, the invention proper consists in that a fluid distributor with fluid outlets the number of which corresponds to the number of the heat exchanger tubes of the heat exchanger is provided upstream the heat exchanger the heat exchanger tubes of which are connected each to one outlet of the fluid distributor. It will be seen that, at suitably selected mechanical and thermodynamic parameters of the heat exchanger tubes which is within the professional knowledge of a person having ordinary skill in the art if he wants to obtain dispersed flow, such arrangement copes with the task of ensuring concurrent flows of the work fluid phases whereby the efficiency of an associated heat pump will considerably be augmented.

Preferably, the fluid distributor will comprise a shell with distribution pipes for introducing a liquid phase of the work fluid terminating above the bottom of the shell, the outlets in the form of pipes protruding downwardly from the bottom of the shell concentrically with the distribution pipes, the cross-sectional flow area of the outlets or pipes being larger than the cross-sectional flow area of the distribution pipes. As will be seen, such fluid distributor is distinguished, in addition to simple structure, by reliable operation as regards even distribution of both phases of the work fluid into the pipes forming the outlets.

The distribution pipes may comprise flow intensity regulator means which permit exact adjustments of flow intensities in individual distribution pipes to a common value whereby uniform distribution of the liquid phase of the work fluid in the outlets is reliably established.

The outlet ends of the distribution pipes above the bottom of the shell of the fluid distributor will preferably be chamfered. Then, descending liquid will exit from the distribution pipes at the lowmost point of the chamfered outlet ends along vertical lines rather than with annular cross-sectional area as would be the case with distribution pipes having even brims. By such concentrated withdrawal of the liquid phase of the work fluid a portion of the cross-sectional area of the outlets is reliably kept free for the inflow of the gaseous fluid phase.

With phases of the work fluid not clearly separated from one another and, therefore, even distribution thereof is jeopardized, a phase separator may be provided upstream the fluid distributor operationally connected thereto and adapted to separate liquids from vapours in a work fluid consisting of a mixture thereof. By such phase separator it is warranted that the work fluid enters the fluid distributor in the form of mutually well separated phases which is a basic condition of reliable and suitable fluid distribution.

In a preferred embodiment the phase separator comprises a shell with a work fluid inlet, a gaseous phase outlet connected to the gaseous phase inlet of the fluid distributor, a liquid phase outlet connected to the distribution pipes of the fluid distributor, and a baffle separator intermediate the work fluid inlet and the liquid phase outlet within and in distance from the shell. Such phase separators are marked by the simplicity of their structure which, nevertheless, ensures a clear separation of different phases of fluids.

In cases where the liquid phase of the work fluid is conveyed by overpressure rather than by gravity, a pump for its delivery will preferably be provided in the pipe conduit which connects the liquid phase outlet of the phase separator with the distribution pipes of the fluid distributor. Providing the pump in such connection pipe means simple assembly work and easy control of operation.

The fluid distributor and the phase separator may be combined to a single unit in a common shell. Where the phases of the work fluid have to be separated prior to distribution, such combined unit has the advantage of moderate space requirement and simple machinery.

Preferably, the common shell will encompass a baffle separator opposite to a work fluid inlet, a liquid collecting tray therebelow distanced from the shell, a baffle plate fixed to the shell opposite to the work fluid inlet and extending above the liquid collecting tray, distribution pipes with chamfered outlet ends protruding downwardly from the bottom of the liquid collecting tray and terminating above the bottom of the common shell, and outlets protruding downwardly from the bottom of the common shell concentrically with the distribution pipes and individually connected to the heat exchanger tubes of the heat exchanger, the cross-sectional flow area of the outlets being larger than the cross-sectional flow area of the distribution pipes. Then, all tasks of a fluid distributor and a phase separator will be performed by a single concise unit of relatively simple structure and of restricted extent. Beyond the general idea of combination the baffle plate fixed to the shell behind the baffle separator as regards the flow direction of vapors ensures that liquid particles carried away by the vapours in spite of having passed the baffle separator are safely conducted into the liquid collecting tray.

Furthermore, the distribution pipes may have reducing nozzles in their entrances. The nozzles are destined, on the one hand, to maintain a liquid level on the liquid collecting tray in any steady state of operation and, on the other hand, to prevent any overflow of the stored liquid directly into the shell. Fulfillment of both requirements favourably enhances the even fluid distribution among the outlets. In knowledge of maximum and minimum flow intensities at given points of the heat pump cycle such requirements are readily met with by skilled art workers.

It has been referred to above that the tube length of heat exchangers in big industrial plants occasionally may amount to cumbersome sizes due to which various sorts of difficulties in manufacture, transport, etc. may arise. In order to avoid such difficulties the heat exchanger of the heat exchanger apparatus may be subdivided into at least two heat exchanger sections with heat exchanger tube sections connected in series as regards fluid flows. Such subdivision is facilitated by the substantially horizontal arrangement of the heat exchanger the sections of which may be mutually superposed whereby required lengths can be achieved in restricted areas.

Series connection of fluid flows means interconnection of the shells and the heat exchanger tube sections of subsequent heat exchanger sections, respectively. Series connection of the shells is self-evident and does not need detailed description. On the other hand, series connection of the heat exchanger tube sections may be carried out in two different ways. More particularly: If clearly separated flows of the phases of the work fluid in the heat exchanger tube sections can be reckoned with, the heat exchanger tube sections of subsequent heat exchanger sections may be individually interconnected by connection pipes. Such interconnection permits to build heat exchangers with heat exchanger tubes of any desired length on a limited area since the originally evenly distributed work fluid flows over from one heat exchanger section into a next one as if it flowed uninterruptedly in continuous long channels.

Flexibility in the choice of performance of various heat exchanger sections is ensured here by the possibility to employ connection pipes which comprise transition profiles for changing their cross-sectional flow area and, thereby, the thermodynamic conditions in a downstream heat exchanger section the diameter of the heat exchanger tube sections of which differ from that in the previous heat exchanger section.

Similar change can be achieved with an arrangement making use of tube plates: both the connection pipes and the heat exchanger tube sections of a subsequent heat exchanger section terminate in mutually opposed tube plates which are interconnected through a gasket with orifices which register with both the connection pipes and the heat exchanger tube sections. Such arrangement obviously permits to join pipes of different diameters and, thereby, to ensure desired thermo-dynamic conditions in subsequent heat exchanger sections as will be evident to persons having ordinary skill in the art.

On the other hand, if phase proportions in an upstream heat exchanger section are liable to become dissimilar thereby endangering similar courses of concurrent temperature changes in different heat exchanger tube sections, series connection of heat exchanger tube sections of subsequent heat exchanger sections will preferably be established by interconnecting such heat exchanger tube sections through a combination of a downstream fluid distributor with an upstream phase separator as described hereinbefore. Such series connection permits to restore uniform distribution of phases in the heat exchanger tube sections of a downstream heat exchanger section which may be unavoidable in big industrial plants.

Moreover, such interconnection obviously permits to change the number of heat exchanger tube sections in two subsequent heat exchanger sections with respect to each other. It means an increased flexibility in design as regards performance and associated operational conditions.

As is known, phases of a fluid tend to flow separately. For instance, the liquid phase of a fluid flows in annular form in tubes while the vaporous phase proceeds in the core of the flow pattern. The phases try to maintain or to regain such flow pattern rather than to flow dispersed in one another. Therefore, where dispersed flow is desired like in the case of hybrid heat pump heat exchangers, intermittent mixing of both phases has to be taken care of, especially in case of long heat exchanger tubes. Such mixing can be obtained by mixer means in the heat exchanger tubes adapted to enhance dispersed flow of a work fluid.

Mixer means for such purposes are well known in the art as goes forth from EP 0 242 838. Deflector surfaces force the phases of a fluid to change places. Since external flow conditions do not change, the phases tend to regain their original places which can be arrived at but by pervading each other whereby intense mixing takes place and dispersed flow is restored at a slight increase of flow resistance.

Hereinafter the invention will be described in closer details by taking reference to the accompanying drawing which shows, by way of example, various embodiments of the invention and in which:

FIG. 1 is a partly sectional elevation showing the main features of the invention.

FIG. 1*a* shows a detail of FIG. 1 at an enlarged scale.

Like reference characters indicate similar details throughout the sheets of the drawing.

Figure 1:
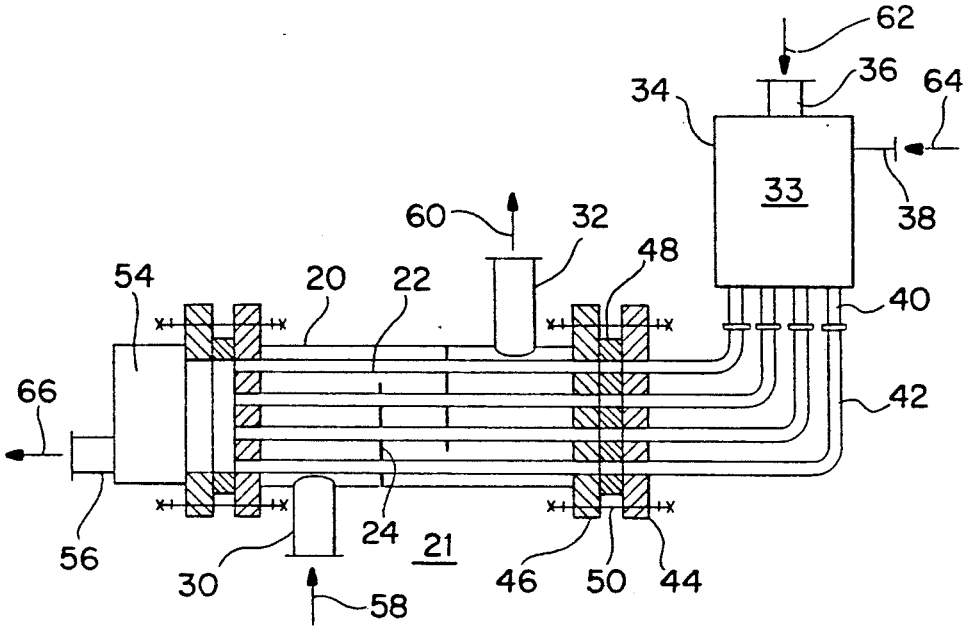

In the drawing reference character 20 designates the shell of a per se known heat exchanger 21 of the shell-and-tube type with heat exchanger tubes 22. Baffle plates 24 in the shell 20 serve for guiding an external medium such as water along a zig-zag line in countercurrent with a work fluid, e.g. a non-azeotropic refrigerant, flowing in the heat exchanger tubes 22. The external medium is introduced into shell 20 through inlet 30 and withdraws therefrom via an outlet 32.

The position of the heat exchanger 21 is, substantially, horizontal. A slight inclination with respect to the horizontal may be employed if a work fluids has to proceed in the heat exchanger tubes 22 under the action of gravity rather than of pressure.

The work fluid is introduced into the heat exchanger tubes 22 from a fluid distributor 33 with a shell 34. In compliance with the main feature of the invention the fluid distributor 33 is provided upstream the heat exchanger 21 as was indicated hereinbefore. Inlets 36 and 38 serve for admitting a pure gaseous and a pure liquid phase, respectively, of the work fluid. Outlets 40 the number of which corresponds to the number of the heat exchanger tubes 22 are connected each to one of the latter by means of connection pipes 42.

Figure 1A:
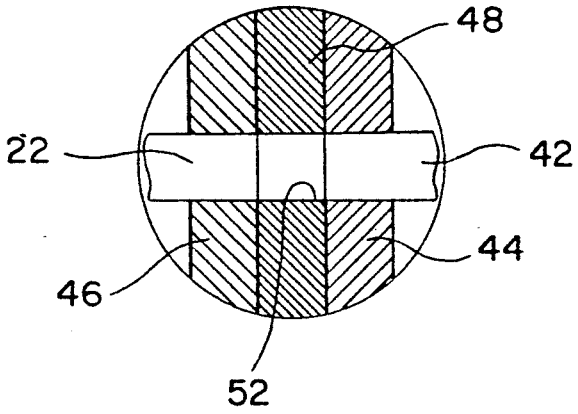

Both the connection pipes 42 and the heat exchanger tubes 22 terminate in mutually opposite tube plates 44 and 46, respectively, interconnected through a gasket 48 by means of through bolts 50. The gasket 48 has orifices 52 which register with both the connection pipes 42 and the heat exchanger tubes 22 so that the work fluid may pass unhindered from the connection pipes 42 into the heat exchanger tubes 22 FIG. 1*a*.

Figure 8:
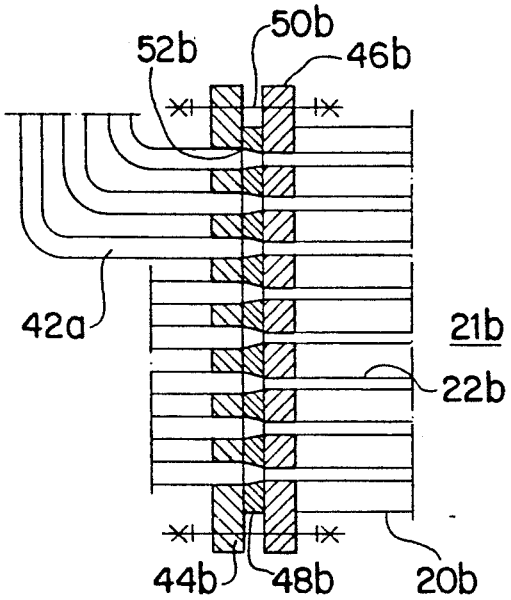
FIG. 8 shows a partly sectional longitudinal view of a detail.

Obviously, such unhindered flow could also be obtained by connection pipes 42 which are fixed to both the outlets 40 and the heat exchanger tubes 22 by means such as welding or spinning in. However, fixing by means of tube plates and gaskets though relatively more expensive permits easy disassembly in case of cleaning or repair. Moreover, it enables the cross-sectional flow area of the work fluid to be changed as will be described hereinafter (FIG. 8).

In the instant case, substantially similar arrangement is employed at the exit end of the heat exchanger tubes 22 which open into a collection chamber 54 with an outlet 56.

In operation, the external fluid is introduced through inlet 30 as indicated by arrows 58. It follows a zig-zag line of flow path between the baffle plates 24 within the shell 20 and, eventually, withdraws through outlet 32 as indicated by arrow 60.

A pure gaseous phase of a work fluid is introduced into the fluid distributor 33 through inlet 36 as indicated by arrow 62. Similarly, a pure liquid phase of the same work fluid is entered through inlet 38 as indicated by arrow 64. Inside the shell 34 of the fluid distributor 33 the two phases become evenly distributed among the outlets 40 in any suitable manner. Consequently, thermodynamic conditions in the heat exchanger tubes 22, more particularly the course of temperature changes therein are the same with a corresponding increase of efficiency of an associated heat pump as was explained in the introductory part of the specification. The work fluid withdraws from the heat exchanger tubes 22 through the collection chamber 54 and the outlet 56 as indicated by arrow 66.

Figure 2:
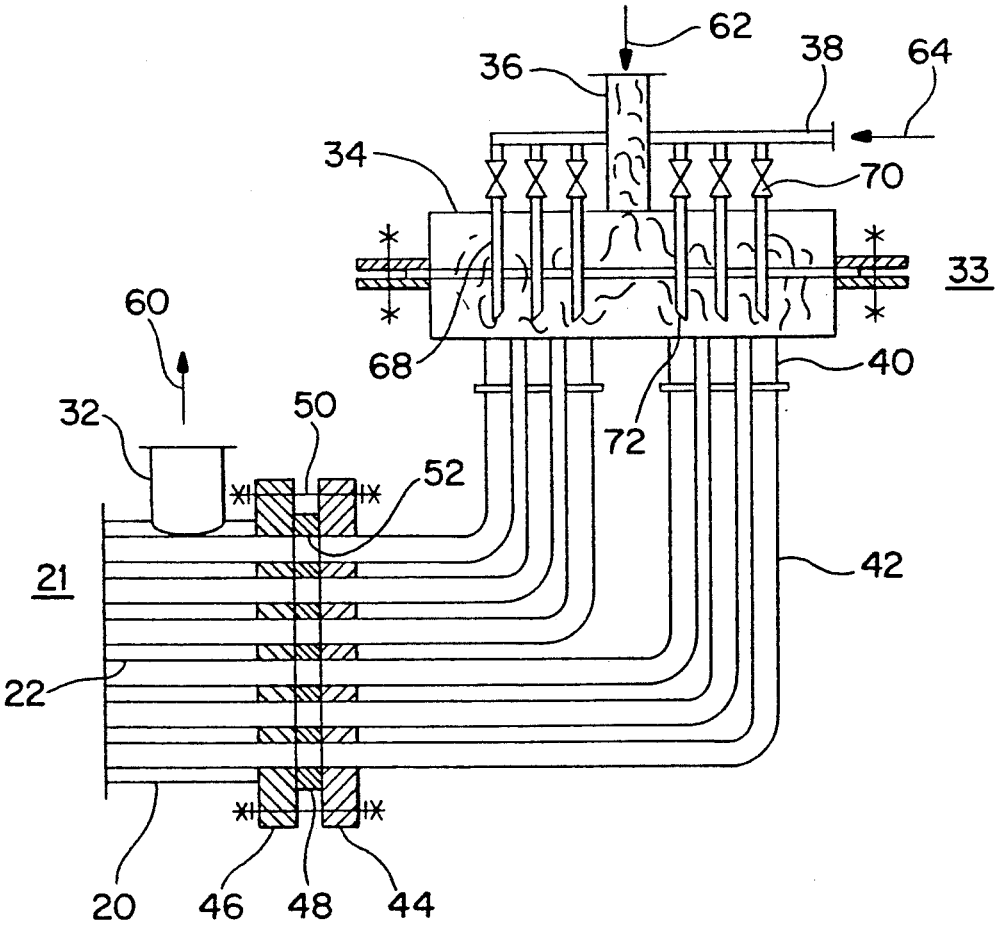
FIG. 2 illustrates a longitudinal sectional view of an exemplified embodiment of a fluid distributor according to the invention at an enlarged scale.

An exemplified embodiment of the fluid distributor 33 is shown in FIG. 2. It comprises a shell 34 with distribution pipes 68 the number of which corresponds to the number of the heat exchanger tubes 22 and, thus, to the number of the outlets 40. The distribution pipes 68 are connected to the liquid phase inlet 38 through regulators 70 which permit to adjust the flow resistance in each distribution pipe 68 in order to ensure the same value of flow intensity therein. The distribution pipes 68 terminate above the bottom of the shell 34 so that there remains a gap therebetween. Moreover, the distribution pipes 68 have chamfered outlet ends 72 the chamfering of which is opposite to the flow direction of the gaseous phase of the work fluid. The outlets 40 in the form of pipes protrude downwardly from the bottom of the shell 34 concentrically with the distribution pipes 68. However, their cross-sectional flow area is larger than the cross-sectional flow are of the distribution pipes 68.

In operation, the gaseous phase of the work fluid enters in the direction of arrow 62 while the liquid phase thereof flows through the regulators 70 into the distribution pipes 68 in which it descends in the form of an annular border layer. Due to the chamfered outlet ends of the distribution pipes 68 the annular form of the cross-sectional flow area of the liquid phase of the work fluid is transformed into single streaks of liquid which exit at the lowmost point of the distribution pipes 68 and drop safely into the inlet orifices of the outlet 40. Thus, the gaseous phase of the work fluid which strikes against the chamfered ends 72 of the distribution pipes 68 and is baffled thereby towards the entrances of the outlets 40 has ample room between the distribution pipe ends 72 and the shell bottom as well as in the outlets 40 for an unimpeded flow.

As a result, both phases of the work fluid are uniformly distributed among the outlets 40 and all heat exchanger tubes 22 receive the same amount of it in the same proportion from the connection pipes 42.

Figure 3:
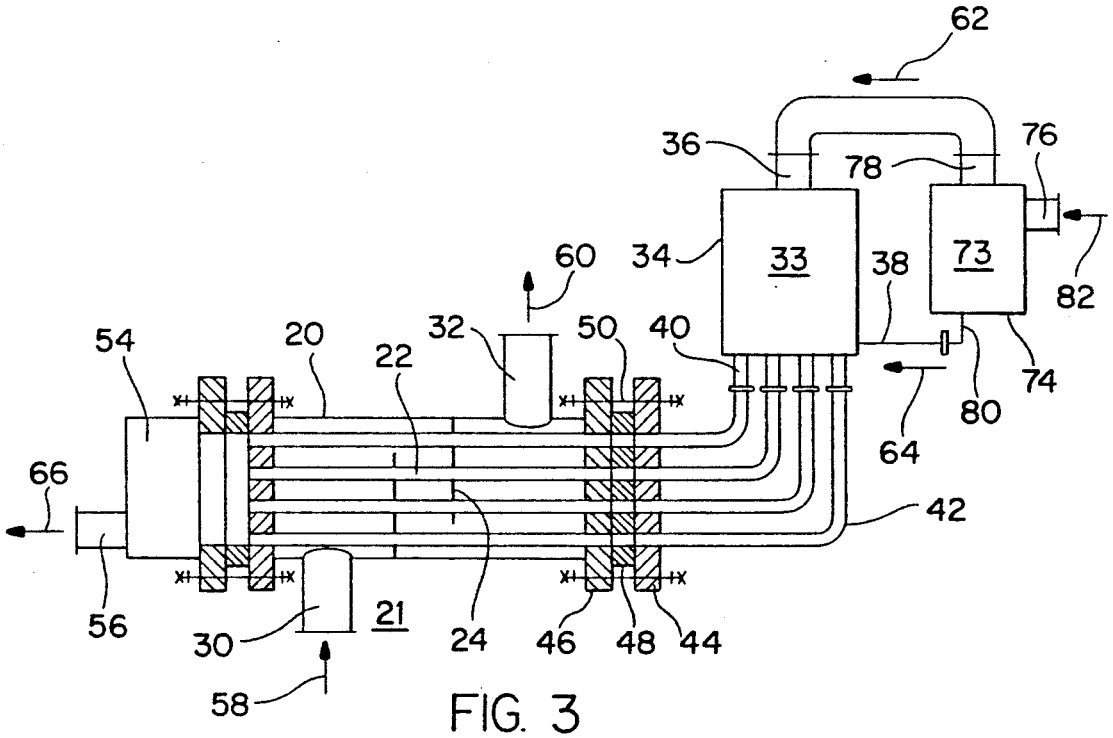
FIG. 3 represents a further embodiment of the invention in a view similar to that of FIG. 1.

If the incoming work fluid is in a wet vapour condition in which its phases are intermixed, even distribution requires their separation prior to admission into a fluid distributor. For such purpose a phase separator 73 may be provided upstream the fluid distributor as shown in FIG. 3.

Again, the phase separator 73 has a shell 74 with a work fluid inlet 76, a gaseous phase outlet 78 and a liquid phase outlet 80. The gaseous phase outlet 78 is connected to the gaseous phase inlet 36 of the fluid distributor 33, and the liquid phase outlet 80 to the liquid phase inlet 38 of the latter. The phase separator 73 comprises means adapted to separate the phases of a work fluid in wet vapour condition from one another, well known in the art.

In operation, such work fluid is received by inlet 76 of the phase separator 73 as indicated by arrow 82. The phases separated from each other withdraw through outlets 78 and 80, and are introduced into the fluid distributor 33 through inlets 36 and 38, respectively, as was the case with the previously described embodiment.

Figure 4:
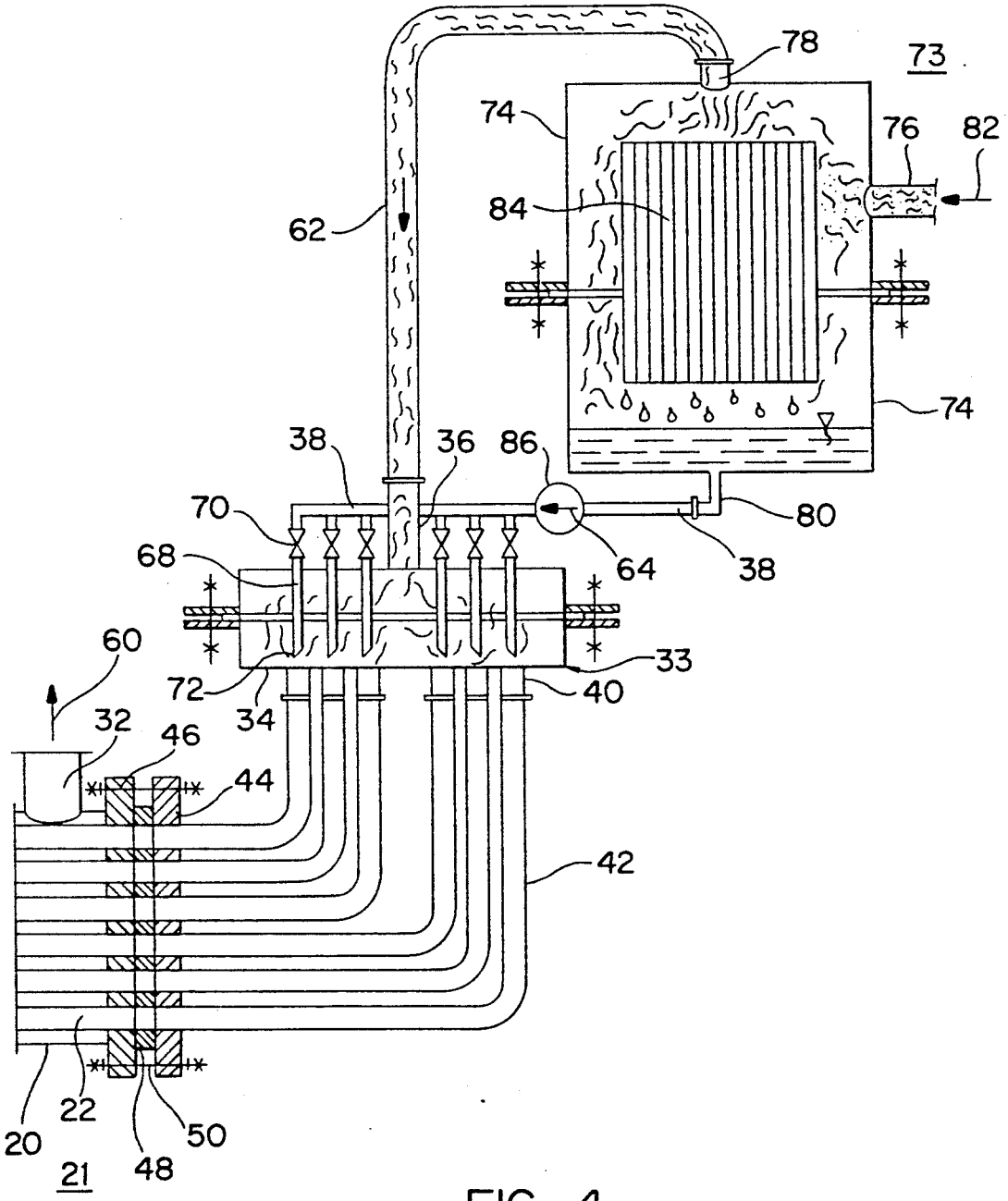
FIG. 4 shows an exemplified embodiment of the invention in a view similar to that illustrated in FIG. 3 yet at an enlarged scale.

Exemplified details of a phase separator suitable to be employed with the invention are illustrated in FIG. 4. In the instant case, the phase separator 73 comprises again a shell 74 with inlets and outlets as described in connection with FIG. 3. The same applies to connections to the fluid distributor. A further feature consist in the provision of a baffle separator 84 which occupies a position within the shell 74 between the work fluid inlet 76 and the liquid phase outlet 80 in distance from the shell 74 proper. Due to such distanced arrangement there is, on the one hand, ample room for the flow of the gaseous phase and, on the other hand, a possibility to use e.g. the bottom portion of the shell 74 as a basin for collecting the liquid running down from the baffle separator 84.

As in the instant case, the inlet 38 of the liquid phase of the work fluid may comprise a delivery pump 86 if pressure drops cannot be coped with otherwise as in case where the fluid distributor 33 is located at an elevated level with respect to the phase separator 73.

In operation the incoming work fluid (arrow 82) strikes against the baffle separator 84 by which collision liquid particles of the work fluid separate out and drop into the liquid collecting basin at the bottom of shell 74. The gaseous phase liberated from carried away liquid particles flows through the outlet 78 into the inlet 36 of the fluid distributor 33 as indicated by arrow 62. Therewhile, the liquid phase collecting at the bottom of shell 74 withdraws through the outlet 80 and is delivered by pump 86 into the inlet 38 as indicated by arrow 64. From there on, operation of the heat exchanger apparatus is similar to that of previously described embodiments.

Figure 5:
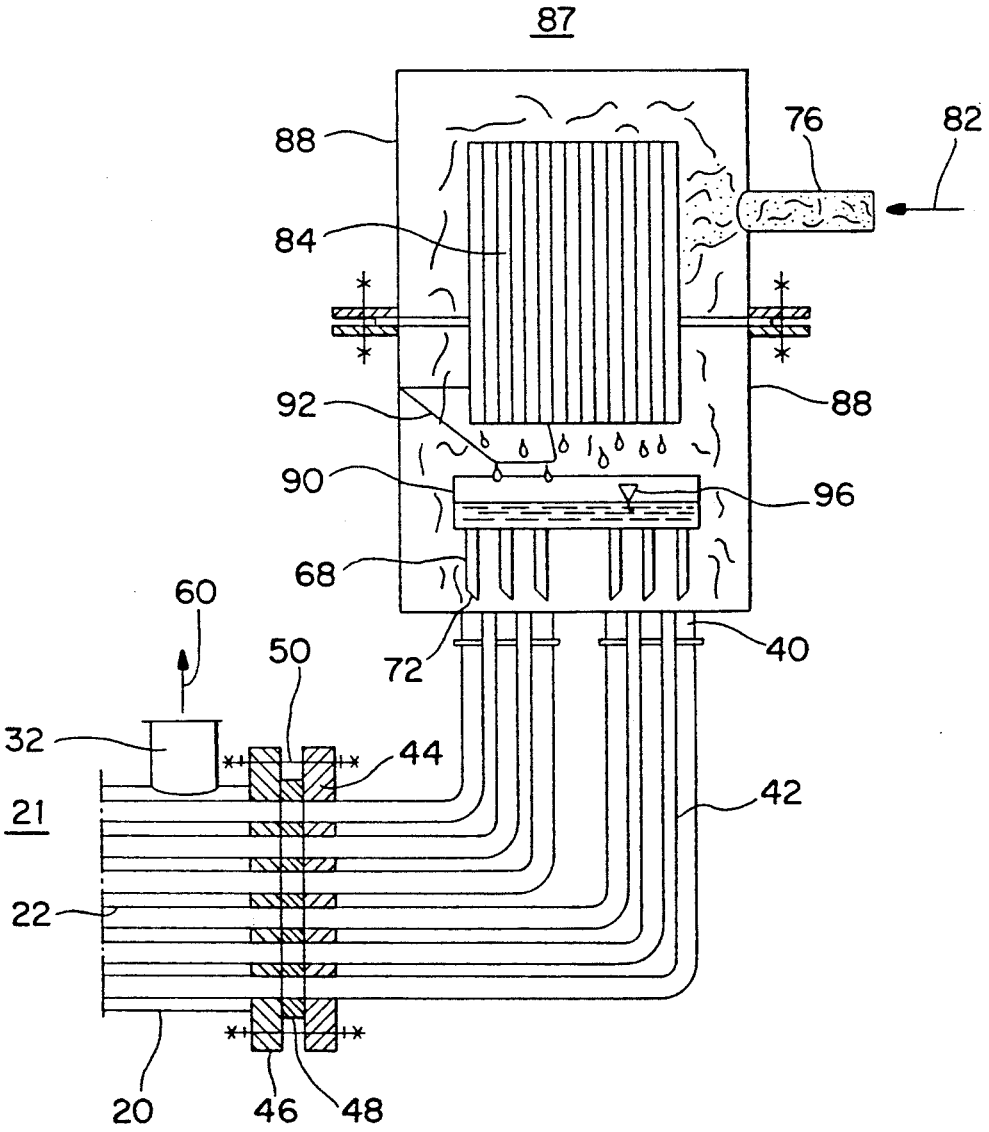
FIG. 5 is a longitudinal sectional view of still another embodiment of the invention.

The fluid distributor 33 and the phase separator 73 may be combined to a single unit 87 in a common shell 88. Such embodiment of the invention is represented in FIG. 5. As shown, the common shell 88 encompasses a baffle separator 84 which occupies a position opposite to the fluid inlet 76 as was the case with the previously described embodiment. Below the baffle separator 84 there is a liquid collecting tray 90 at a distance from the shell 88. The shell 88 has a baffle plate 92 fixed thereto at an opposite side with respect to the work fluid inlet 76. The baffle plate 92 extends above the liquid collecting tray 90 so that liquid droplets precipitating thereon will be forced to run down into the liquid collecting tray 90. There are again distribution pipes 68 which protrude downwardly from the bottom of the liquid collecting tray 90 the number of which corresponds, as in the cases of previously described embodiments, to the number of heat exchanger tubes 22 of the heat exchanger 21. They terminate above the bottom of the common shell 88 and have chamfered outlet ends 72 which look groupwise toward the sides of the shell 88 from where the gaseous phase flows inwardly.

Still again, outlets 40 in the form of pipes protrude downwardly from the bottom of the shell 88 concentrically with the distribution pipes 68 as was, likewise, the case with previously described embodiments. The outlets 40 are individually connected to the heat exchanger tubes 22 of the heat exchanger 21 and their cross-sectional flow area is, again, larger than the cross-sectional flow area of the distribution pipes 68 protruding from the bottom of the liquid collecting tray 90.

Figure 6:
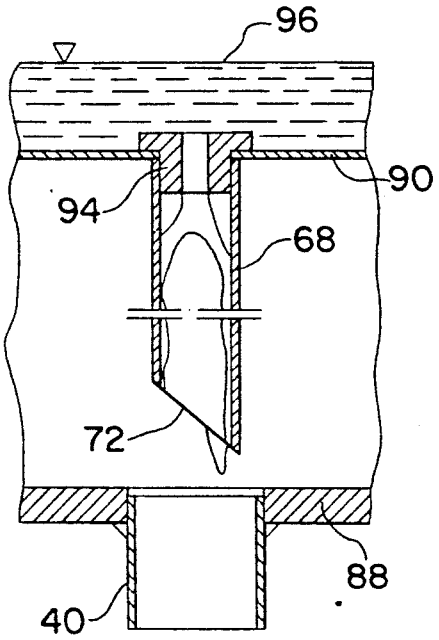
FIG. 6 illustrates a detail of FIG. 5 with some additional details at an enlarged scale.

Moreover, in the instant case, reducing nozzles 94 are provided in the entrances of the distribution pipes 68 as shown in FIG. 6 of the drawing. The size of the nozzles 94 has to be selected so that in all possible stable operational conditions a suitable level of liquid appear on the liquid collecting tray 90 while no overflows of liquid should occur above the brim thereof. As has been hinted at, in knowledge of maximum and minimum flow intensities at a given point of a desired cycle sizing of the nozzles 94 will be routine work to a person having ordinary skill in the art. The orifices of the nozzles 94 may be eccentric with respect to the distribution pipes 68 if desired for any reason of design or operation.

Obviously, the unit 87 and, more particularly, the liquid collecting tray 90 have to be adjusted so as to occupy exact horizontal positions since, otherwise, fluid column heights above the nozzles 94 will not be equal by which uniform distribution of the liquid phase would be frustrated.

In operation, the work fluid incoming through inlet 76 as indicated by arrow 82 strikes against baffle separator 84 whereupon its liquid particles separate out and drop into the liquid collecting tray 90 while the gaseous phase of the work fluid approaches the bottom of shell 88 through the gaps left between the shell 88 and the baffle separator 84. A liquid level 96 of constant pressure column ensures that the distribution pipes 68 will uniformly be supplied with the liquid phase of the work fluid. The descending liquid drops from the lowmost points of the chamfered outlet ends 72 into the outlets 40 so that a suitable cross-sectional flow area is kept free for the gaseous work fluid phase which flows against the chamfered outlet ends 72 and becomes baffled thereby likewise into the outlets 40. Thus again, the heat exchanger tubes 22 receive even amounts of the work fluid in the same proportion of its phases due to the operation of the work fluid distributor's means for distributing liquid and gaseous phases.

Figure 7:
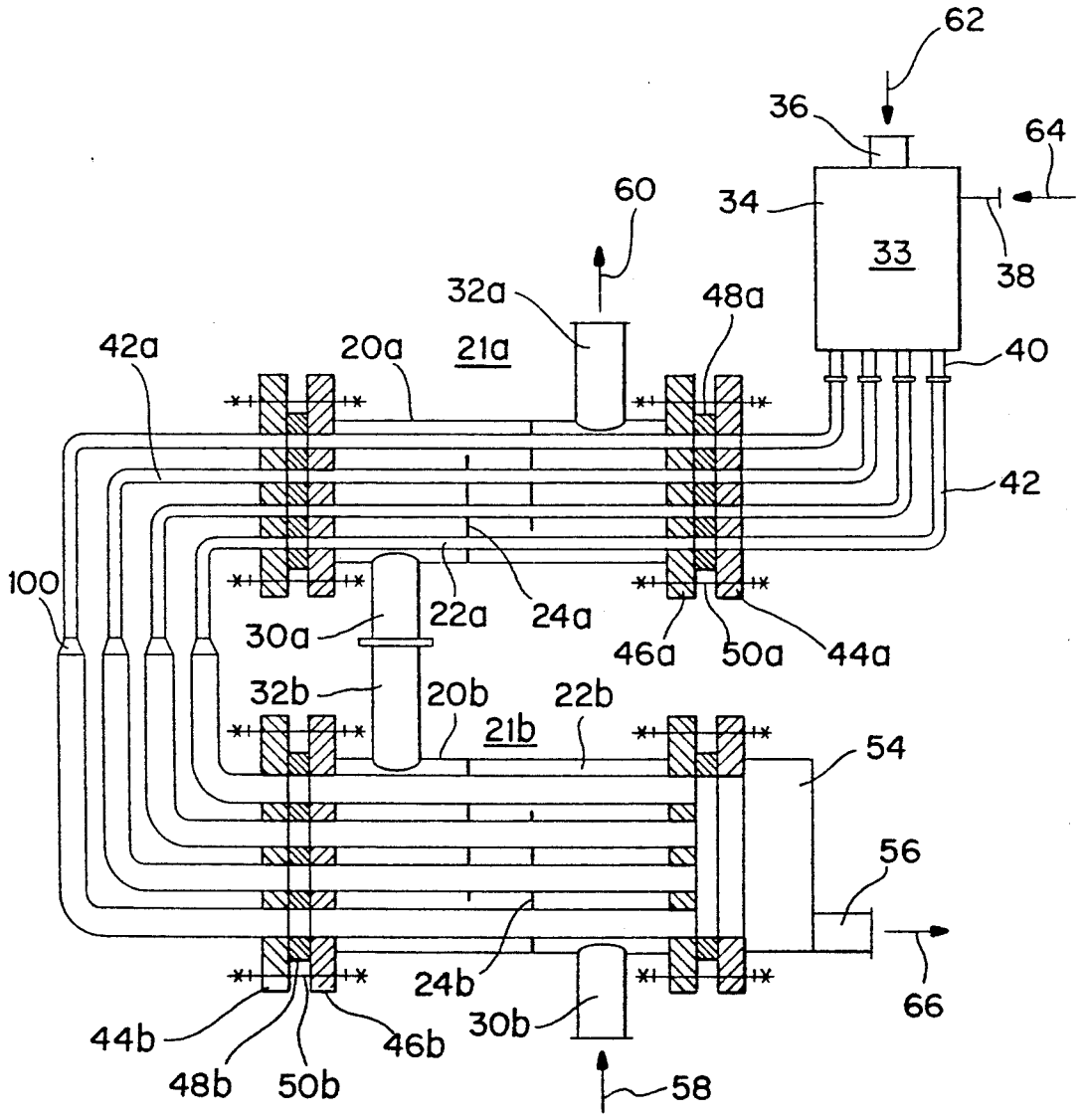
FIG. 7 represents a still further embodiment of the invention in a partly sectional elevation.
Figure 10:
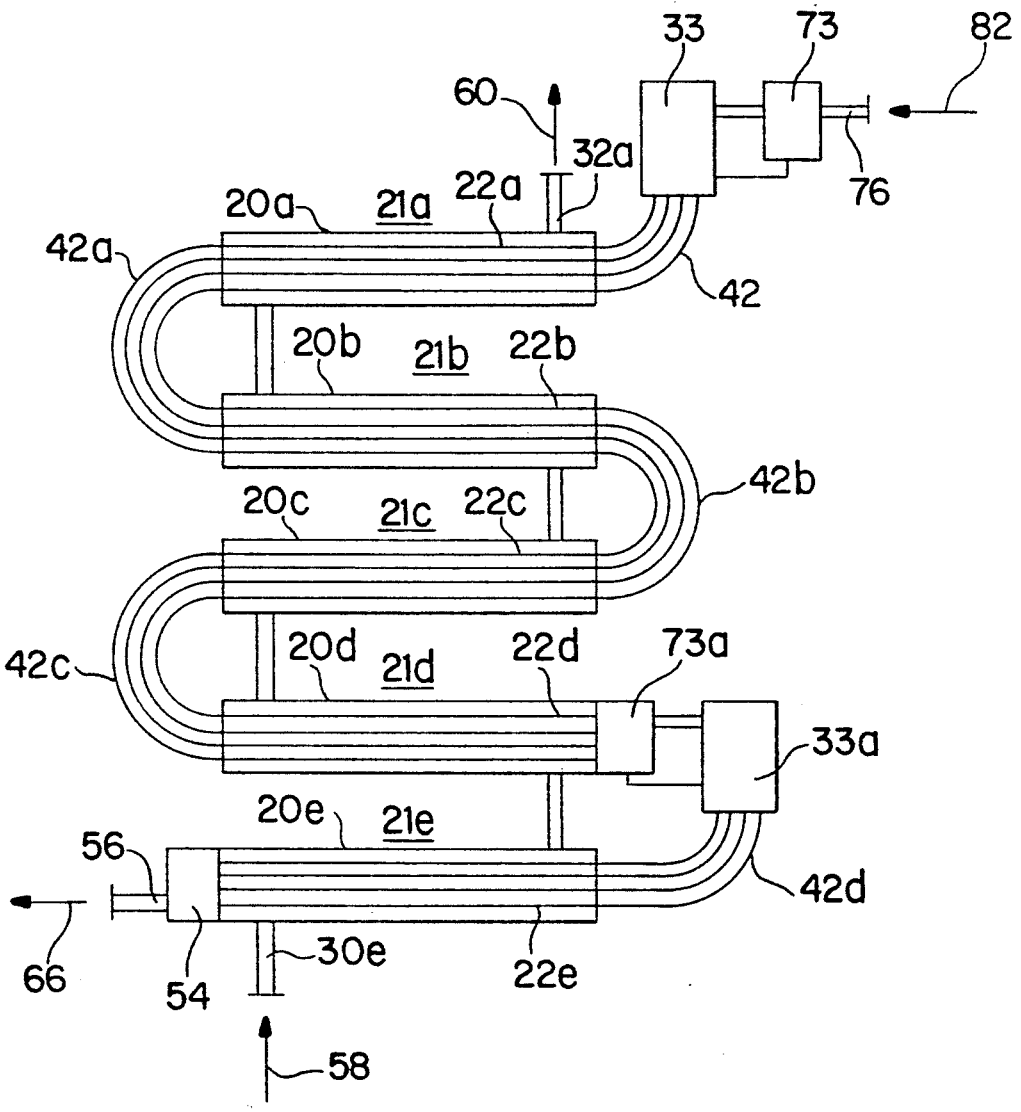
FIG. 10 illustrates a diagrammatic view of a still further embodiment of the invention. Finally.

As has been mentioned, required lengths of the heat exchanger tubes 22 may reach considerable values of 30 to 40 meters which means difficulties in many respects. The invention copes with such difficulties by subdividing the heat exchanger 21 into at least two heat exchanger sections 21*a* and 21*b* connected in series as represented in FIG. 7 of the drawing. The affixes "a" and "b" to reference characters used in previously described figures indicate corresponding parts of the heat exchanger sections 21*a* and 21*b*, respectively. The same applies to cases where further minuscule letters are used (FIG. 10).

In the instant case, the heat exchanger sections 21*a* and 21*b* are mutually superposed which means a halving of the desired lengths of space requirement. The greater the number of subdivision sections, the smaller, relatively, the length of the space required to accommodate a heat exchanger of given size. If the heat exchanger is subdivided into more than two sections, some of the heat exchanger sections may occupy the bays between two superposed sections whereby even more concise and, at the same time, less high arrangements can be achieved.

Series connection of the heat exchanger sections 21*a* and 21*b* consists in interconnecting both the shells 20*a* and 20*b*, and the heat exchanger tube sections 22*a* and 22*b*, respectively. Series connection of the shells is of no problem. On the other hand, series connection of the heat exchanger tube sections 22*a* and 22*b* offers two alternatives.

The heat exchanger tube sections 22*a* and 22*b* may be interconnected individually by means of connections pipes 42*a* as illustrated in FIG. 7. In such case the work fluid passes the heat exchanger sections 21*a* and 21*b* as if it flowed in a continuous pipe conduit uninterruptedly. Nevertheless, it is possible to adapt flow conditions to thermodynamic requirements as will be shown hereinafter.

It may be obtained by inserting transition profiles into the connection pipes 42*a*.

In the instant case, such transition profiles 100 enlarge the diameters of the heat exchanger tube sections 22*b* of the subsequent heat exchanger section 21*b* which corresponds to the operational requirements of the evaporator of hybrid heat pumps.

However, the transition profiles may have continuously decreasing diameters as well which is the case e.g. with the condensers of hybrid heat pumps the heat exchangers of which require decreased cross-sectional flow areas towards the end of heat exchange.

Such changes of tube diameters may be obtained also by correspondingly perforated gaskets as shown in FIG. 8. Here, the gasket 48*b* has conical orifices 52*b* which contract towards the heat exchanger tube sections 22*b* of the subsequent heat exchanger section 21*b* thereby reducing the cross-sectional flow area as required.

Figure 9:
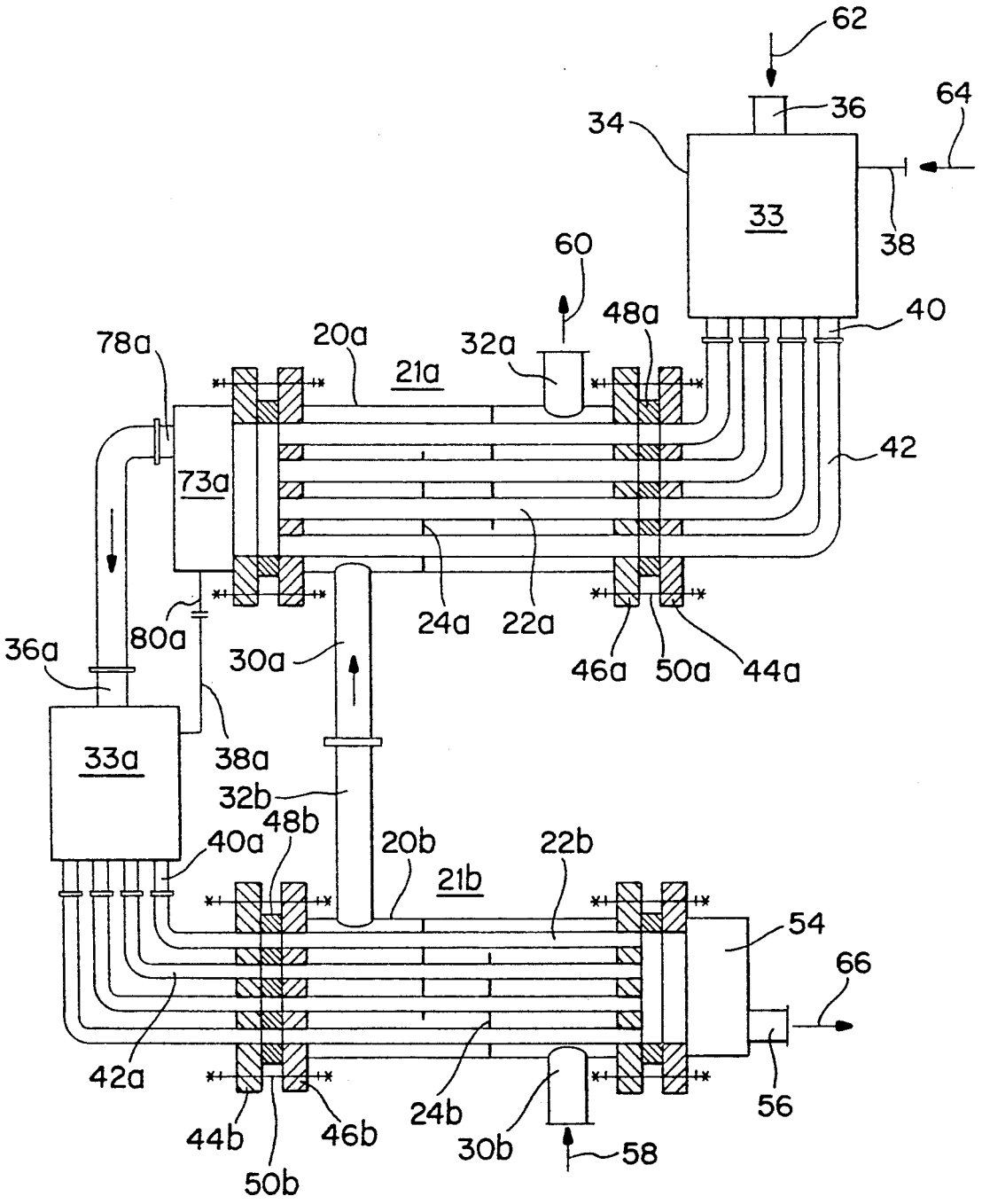
FIG. 9 is a longitudinal sectional view of still another embodiment of the invention.

Another alternative of connecting in series subsequent heat exchanger sections is illustrated in FIG. 9. Here, the heat exchanger tube sections 22*a* of heat exchanger section 21*a* are connected to heat exchanger tube sections 22*b* of heat exchanger section 21*b* through a combination of a fluid distributor 33*a* with a phase separator 73*a*. Naturally, the phase separator 73*a* lies upstream the fluid distributor 33*a* which is downstream with respect thereto. The connection is obviously the same as with the embodiment shown in FIG. 3 so that description of details may be dispensed with.

In operation, the fluid passing the heat exchanger tube sections 22*a* is collectively introduced into the phase separator 73*a* rather than into individual connection pipes as in the previously described embodiment. Thus, the phases of the work fluid become separated from each other and introduced separately into the fluid distributor 33*a* where they will be uniformly distributed among the outlets 40*a* and, thus, among the heat exchanger tube sections 22*b* of the subsequent heat exchanger section 21*b*, similarly to what takes place in the embodiment shown in FIG. 3.

Series connection of heat exchanger sections by means of combined phase separator and fluid distributor is of significant importance where a renewed distribution of the work fluid phases appears necessary which may be the case with large industrial plants where a plurality of heat exchanger sections is employed and, therefore, flow paths may be of considerable length.

However, a further advantage of the above described series connection of heat exchanger sections consists in that it permits to change the number and/or the diameter of the heat exchanger tube sections of subsequent heat exchanger sections as in case of FIG. 9 where the diameters of the heat exchanger tube sections 22*b* is smaller than that of the heat exchanger tube sections 22*a* in the previous heat exchanger section 21*a*. By such versatility a series connection by means of a combination of a phase separator and a fluid distributor may turn out justified even in case of but two heat exchanger sections as shown in FIG. 9, that is in relatively small equipments for domestic use.

On the other hand, big industrial plants will show the use of both alternatives mentioned above since there uninterrupted long flow paths and intermittent redistribution of the work fluid phases may be equally necessary. A diagrammatic view of such plant is illustrated in FIG. 10. Its heat exchanger is subdivided into five heat exchanger sections 21*a*, 21*b*, 21*c*, 21*d* and 21*e*. The first four heat exchanger sections 21*a*, 21*b*, 21*c* and 21*d* are connected in series by connection pipes 42*a*, 42*b* and 42*c*, respectively. On the other hand, heat exchanger sections 21*d* and 21*e* are interconnected through a combination of a downstream fluid distributor 33*a* with an upstream phase separator 73*a* since it is supposed or ascertained that the work fluid having passed four heat exchanger sections in uninterrupted continuous flow certainly needs redistribution prior to passing and leaving the last heat exchanger section 21*c*.

Figure 11:
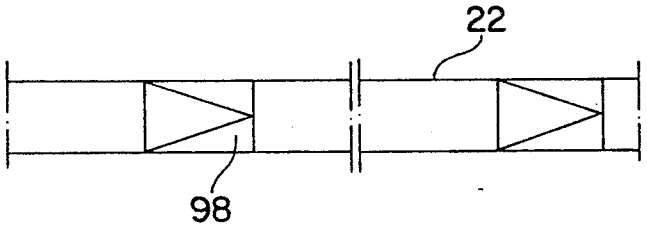
FIG. 11 is a longitudingal sectional view of a heat exchanger tube section with mixer means therein.

As has been explained, dispersed flow of the work fluid is a basic requirement for a similar course of temperature changes of both its phases. In addition to suitably selected thermodynamic parameters dispersed flow may be enhanced by mechanical means as well. For such purpose mixer means may be inserted into the heat exchanger tubes or, what is the same, into their sections as shown by FIG. 11 which illustrates a portion of a heat exchanger tube 22 with a mixer means 98 therein. As has been stated, such means are known in the art and, therefore, do not need closer description. The essence of their functioning is to induce the gaseous and liquid phases of the work fluid to pervade each other by forcing them to change places. This is obtained by means of deflector surfaces which baffle the phases out of their ordinary flow paths which they try to regain as soon as possible whereby repeated mutual pervasions take place restoring dispersed nature of flow.

We claim:

1. Heat exchanger apparatus comprising a substantially horizontal countercurrent heat exchanger of the shell-and-tube type having heat exchanger tubes and operating with non-azeotropic work fluids, characterized in that a fluid distributor with fluid outlets, the number of which corresponds to the number of the heat exchanger tubes of the heat exchanger, is provided upstream of the heat exchanger and the heat exchanger tubes are connected each to one fluid outlet of the fluid distributor.

2. Heat exchanger apparatus as claimed in claim 1, characterized in that the fluid distributor (33) comprises a shell (34) with distribution pipes (68) terminating above the bottom of the shell for introducing a liquid phase of the work fluid, the fluid outlets (40) protruding downwardly from the bottom of the shell concentrically with the distribution pipes, and the cross-sectional flow area of the fluid outlets being larger than the cross-sectional flow area of the distribution pipes.

3. Heat exchanger apparatus as claimed in claim 2, characterized by flow intensity regulator means (70) in line with the distribution pipes (68).

4. Heat exchanger apparatus as claimed in claim 2, characterized in that the distribution pipes (68) have chamfered outlet ends (72).

5. Heat exchanger apparatus as claimed in claim 2, characterized in that a phase separator (73) is provided upstream of the fluid distributor (33) and is connected in series therewith and adapted to separate liquid from vapour in a work fluid comprised of a mixture of the liquid and vapor.

6. Heat exchanger apparatus as claimed in claim 5, characterized in that the phase separator (73) comprises a shell (74) with a work fluid inlet (76), a gaseous phase outlet (78) connected to the gaseous phase inlet (36) of the fluid distributor (33), a liquid phase outlet (80) connected to the distribution pipes (68) of the fluid distributor, and a baffle separator (84) intermediate the work fluid inlet and the liquid phase outlet within and in distance from the shell.

7. Heat exchanger apparatus as claimed in claim 6, characterized by the provision of a pump (86) in a pipe conduit (38) connecting the liquid phase outlet (80) of the phase separator (73) with the distribution pipes (68) of the fluid distributor (33).

8. Heat exchanger apparatus as claimed in claim 5, characterized in that the fluid distributor (33) and the phase separator (73) are combined to a single unit (87) in a common shell (88).

9. Heat exchanger apparatus as claimed in claim 8, characterized in that the common shell (88) encompasses a baffle separator (84) opposite to a work fluid inlet (76), a liquid collecting tray (90) positioned below said baffle separator and distanced from the shell, a baffle plate (92) fixed to the shell opposite to the work fluid inlet and extending above the liquid collecting tray, distribution pipes (68) with chamfered outlet ends (72) protruding downwardly from the bottom of the liquid collecting tray and terminating above the bottom of the common shell, and outlets (40) protruding downwardly from the bottom of the common shell concentrically with the distribution pipes and individually connected to the heat exchanger tubes (22) of the heat exchanger (21), the cross-sectional flow area of the outlets being larger than the cross-sectional flow area of the distribution pipes (FIG. 5).

10. Heat exchanger apparatus as claimed in claim 9, characterized by reducing nozzles (94) in the entrances of the distribution pipes (68).

11. Heat exchanger apparatus as claimed in claim 1, characterized in that the heat exchanger (21) is subdivided into at least two heat exchanger sections (21*a*, 21*b*, etc.) with heat exchanger tube sections (22*a*, 22*b*, etc.) connected in series with regard to fluid flows.

12. Heat exchanger apparatus as claimed in claim 11, characterized in that the heat exchanger tube sections (22*a*, 22*b*, etc.) of subsequent heat exchanger sections (21*a*, 21*b*, etc.) are individually interconnected by connection pipes (42*a*, 42*b*, etc.).

13. Heat exchanger apparatus as claimed in claim 12, characterized in that the connection pipes (42*a*) comprise transition profiles (100) for changing the cross-sectional flow area of the working fluid flowing through said connection pipes.

14. Heat exchanger apparatus as claimed in claim 12, characterized in that both the connection pipes (42*a*) and the heat exchanger tube sections (22*b*) of a subsequent heat exchanger section (21*b*) terminate in mutually opposed tube plates (44*b*, 46*b*) which are interconnected through a gasket (48*b*) with orifices (52*b*) which register with both the connection pipes and the heat exchanger tube sections.

15. Heat exchanger apparatus as claimed in claim 11, characterized in that the heat exchanger tube sections (22*a*, 22*b*, etc.) of subsequent heat exchanger sections (21*a*, 21*b*, etc.) are interconnected through a combination of a downstream fluid distributor (33*a*) with an upstream phase separator (73*a*).

16. Heat exchanger apparatus as claimed in claim 1, characterized by mixer means (98) in the heat exchanger tubes (22) adapted to enhance dispersed flow of the work fluid.

17. An apparatus, comprising:

a horizontally orientated heat exchanger adapted for operation with a non-azeotropic work fluid, said heat exchanger including heat exchanger tubes with each heat exchanger tube having an inlet;

a work fluid distributor positioned upstream of said heat exchanger and including a first inlet for receiving a gaseous phase of the non-azeotropic working fluid and a second inlet for receiving a liquid phase of the non-azeotropic working fluid, said working fluid distributor including means for distributing the liquid phase and the gaseous phase such that the inlet of each of said heat exchanger tubes receives an even amount of the working fluid in a same gas/liquid proportion received by said first and second inlets of said work fluid distributor.

18. An apparatus as recited in claim 17, wherein said means for distributing the liquid phase and gaseous phase includes a shell into which said gaseous phase inlet opens and a plurality of distribution pipes having one end in fluid communication with said liquid phase inlet and an open second end positioned within said shell, said means for distributing the liquid phase and gaseous phase further including a plurality of fluid outlets with each fluid outlet extending off from a bottom surface of said shell and each fluid outlet having an end connected to said shell and an opposite end in fluid communication with a respective one of said heat exchanger tubes, said second end of said distribution pipes being positioned above the bottom surface of said shell and concentrically arranged with respect to said fluid outlets, and said fluid outlets having a cross-sectional flow area which is larger than the cross-sectional flow area of said distribution pipes.

19. An apparatus as recited in claim 18, wherein the second end of said distribution pipes is chamfered and said distribution pipes including in line flow regulators.

20. An apparatus as recited in claim 17, further comprising phase separation means for receiving a mixed liquid and gaseous phase work fluid and separating the liquid and gaseous phase of said mixed work fluid and directing the separated gaseous phase to the first inlet of said work fluid distributor and the separated liquid phase to the second inlet of said work fluid distributor.

21. A heat exchanger apparatus, comprising:

a substantially horizontal counter-current heat exchanger having a shell-and-tube configuration and essentially horizontally extending heat exchanger tubes;

a fluid distributor positioned upstream of said heat exchanger and including a shell, fluid outlets opening downwardly from said shell of a number which corresponds to the number of said heat exchanger tubes, vertically orientated liquid distribution pipes positioned in said shell and of a number which corresponds to the number of said fluid outlets and which each terminate above a respective one of said fluid outlets so as to be concentrically positioned with respect to said fluid outlets; and connection pipes connecting each of said downwardly opening fluid outlets with a respective one of said heat exchanger tubes.

* * * * *